US010550668B2

(12) United States Patent
Resendez

(10) Patent No.: US 10,550,668 B2
(45) Date of Patent: Feb. 4, 2020

(54) VORTICES INDUCED HELICAL FLUID DELIVERY SYSTEM

(71) Applicant: Esteban Resendez, Baton Rouge, LA (US)

(72) Inventor: Esteban Resendez, Baton Rouge, LA (US)

(73) Assignee: Esteban Resendez, Baton Rouge, LA (US)

( * ) Notice: Subject to any disclaimer, the term of this patent is extended or adjusted under 35 U.S.C. 154(b) by 224 days.

(21) Appl. No.: 15/690,573

(22) Filed: Aug. 30, 2017

(65) Prior Publication Data

US 2018/0058178 A1 Mar. 1, 2018

Related U.S. Application Data

(60) Provisional application No. 62/382,423, filed on Sep. 1, 2016.

(51) Int. Cl.
*E21B 37/00* (2006.01)

(52) U.S. Cl.
CPC ..... *E21B 37/00* (2013.01)

(58) Field of Classification Search
None
See application file for complete search history.

(56) References Cited

U.S. PATENT DOCUMENTS 5,505,262 A * 4/1996 Cobb ..... E21B 7/18 134/198
6,065,541 A * 5/2000 Allen ..... E21B 23/04 166/318
6,923,871 B2 * 8/2005 Walker ..... B08B 9/0433 134/24
7,404,416 B2 * 7/2008 Schultz ..... F15C 1/22 137/835
8,863,835 B2 * 10/2014 Schultz ..... E21B 28/00 166/244.1
8,931,558 B1 * 1/2015 Harper ..... E21B 4/02 134/167 C
8,960,297 B1 * 2/2015 Pinson ..... E21B 43/38 166/173
9,932,798 B1 * 4/2018 Resendez ..... E21B 41/0078
2006/0086507 A1 * 4/2006 Surjaatmadja ..... E21B 37/00 166/312
2017/0002627 A1 * 1/2017 Greening ..... E21B 28/00
2017/0152726 A1 * 6/2017 Ross ..... E21B 37/00

* cited by examiner

*Primary Examiner* — Nina Bhat

(57) ABSTRACT

A vortices induced helical fluid delivery system that creates a fluid pattern with cavitation, helical and acoustic (pulsating) oscillating methods with no mechanical moving parts within the technology without being limited to pressures, temperatures, volumes or fluid type that more efficiently clean out scale and debris build-up from a productive or formerly productive oil, gas or wastewater wells, including perforations and near region that surrounds the well. There are varying sized bearings/spheres that can be placed in each chamber that are hydraulically driven that reduce the total flow area (instead of slow down the fluid). The technology can be externally altered to encompass drill string operations to help improve drilling operations by reducing friction and improving annular fluid flow by the inherent vibration that is created by the technology.

4 Claims, 2 Drawing Sheets

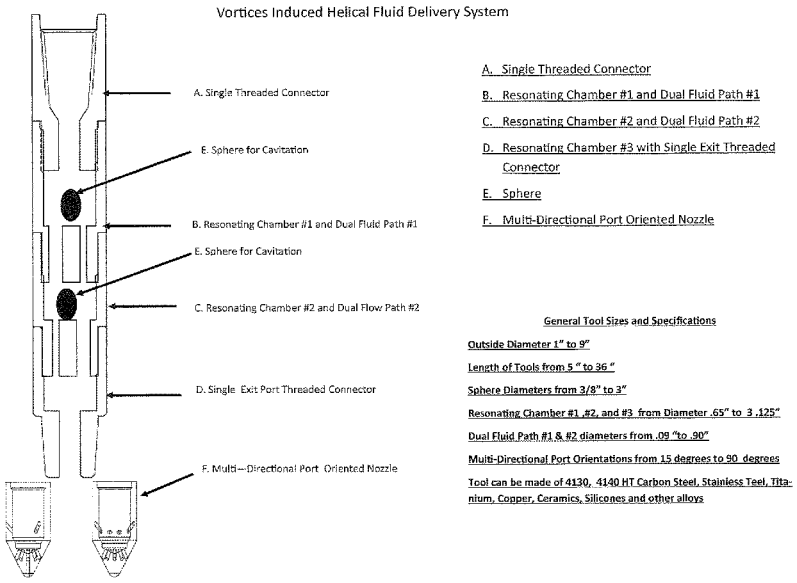

Figure #1

Vortices Induced Helical Fluid Delivery System

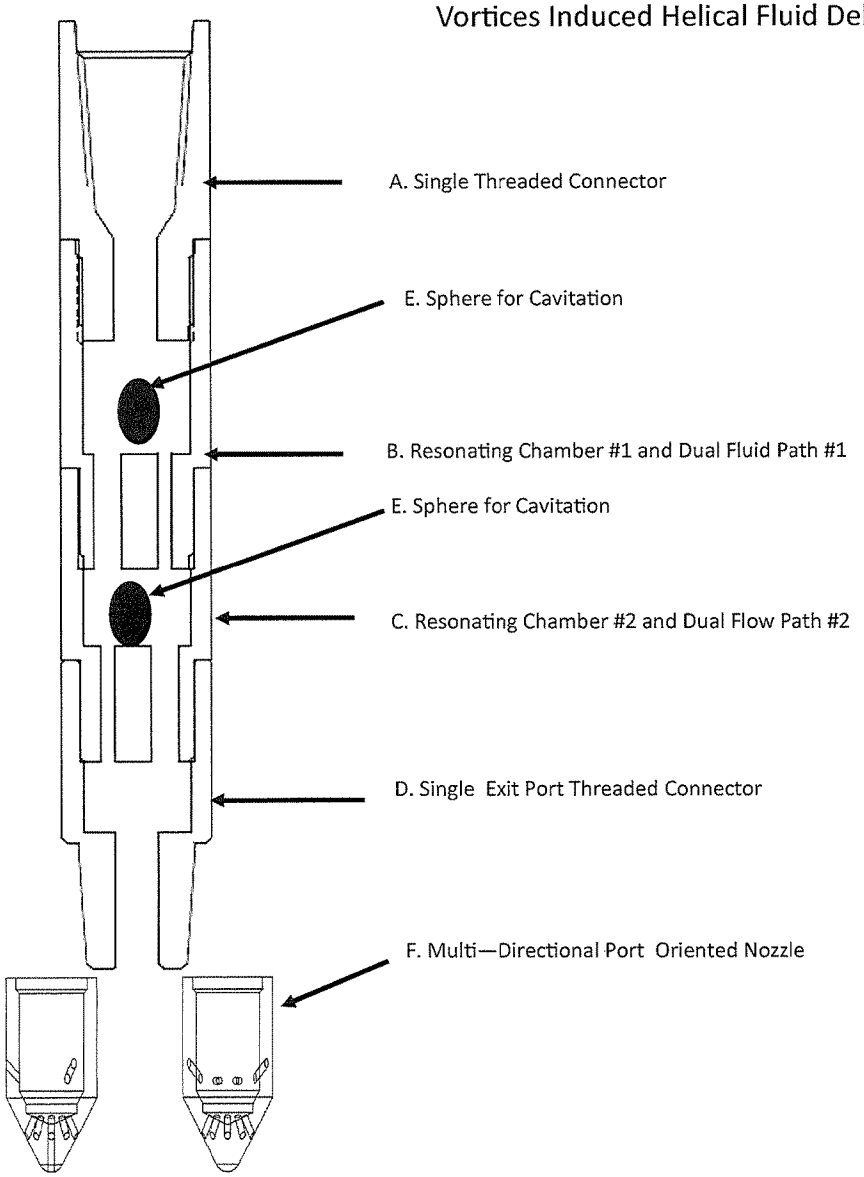

A. Single Threaded Connector

B. Resonating Chamber #1 and Dual Fluid Path #1

C. Resonating Chamber #2 and Dual Fluid Path #2

D. Resonating Chamber #3 with Single Exit Threaded Connector

E. Sphere

F. Multi-Directional Port Oriented Nozzle

General Tool Sizes and Specifications

Outside Diameter 1" to 9"

Length of Tools from 5 " to 36 "

Sphere Diameters from 3/8" to 3"

Resonating Chamber #1 ,#2, and #3 from Diameter .65" to 3 .125"

Dual Fluid Path #1 & #2 diameters from .09 "to .90"

Multi-Directional Port Orientations from 15 degrees to 90 degrees

Tool can be made of 4130, 4140 HT Carbon Steel, Stainless Teel, Titanium, Copper, Ceramics, Silicones and other alloys

Figure #2

Vortices Induced Helical Fluid Delivery System Parts Layout

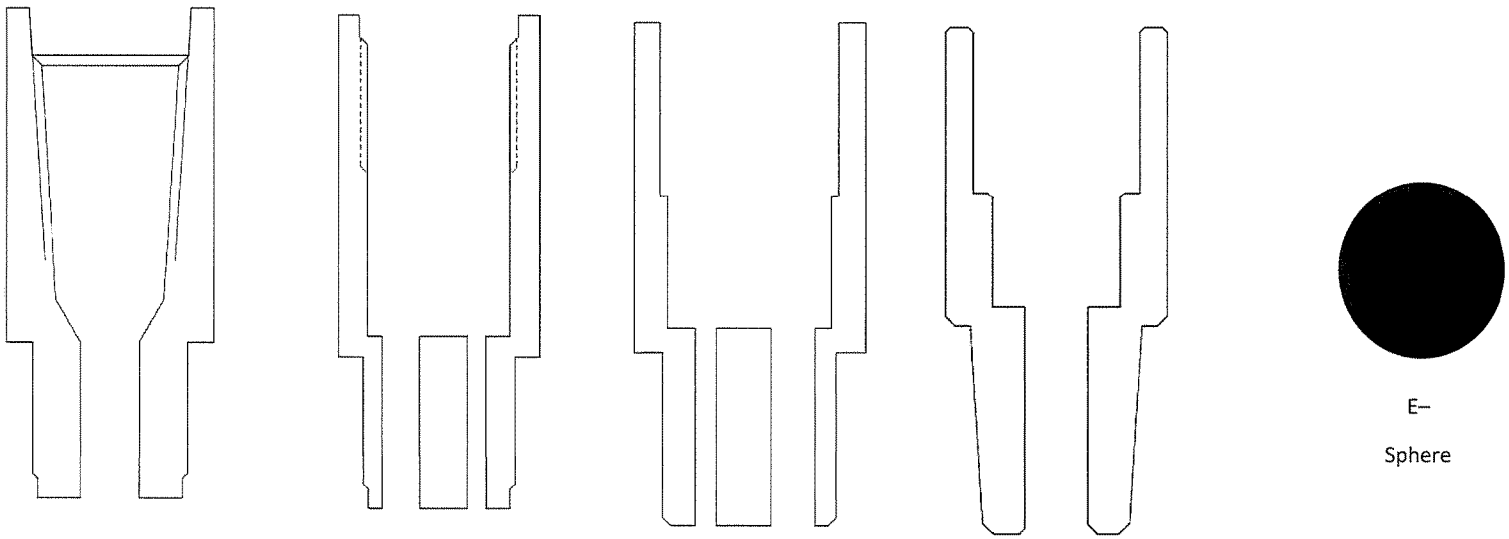

A– Single Threaded Connector

B- Resonating Chamber #1 and Dual Fluid Path #1

C- Resonating Chamber #2 and Dual Fluid Path #2

D- Resonating Chamber #3 with Single Exit Threaded Connector

E– Sphere

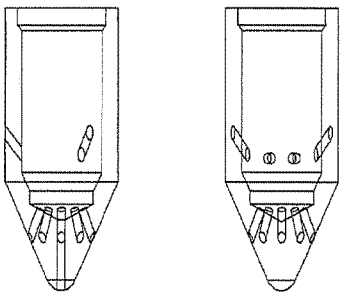

F- Multi-Directional Port Oriented Nozzle

A. Single Threaded Connector
B. Resonating Chamber #1 and Dual Fluid Path #1
C. Resonating Chamber #2 and Dual Fluid Path #2
D. Resonating Chamber #3 with Single Exit Threaded Connect-
or
E. Sphere
F. Multi-Directional Port Oriented Nozzle

VORTICES INDUCED HELICAL FLUID DELIVERY SYSTEM

FIELD OF THE INVENTION

The present invention is in the technical field of oil, gas, water and wastewater well ("Well(s)") for the purpose of assisting with extended reach into a Well and properly cleaning out the Well, perforations, and near region that surrounds the Well from scale and debris (remediation). In the construction of the current flow patterns of this invention, various materials have been selected acrylics, carbon steel, ceramics, brass, stainless steels, silicones and carbon fiber which offer a number of diverse properties, static flow, cavitation, acoustic (pulsating), oscillation (switching), helical, spinning and allow for varied functions of the article. For cavitation, acoustic, helical, and oscillation the article has two asymmetrical flows and introduces fluid asymmetrical flow into a single chamber, and alternately switching paths from smaller hole to larger hole to create a vortex and when a sphere is inserted into the chamber wherein a low pressure (below sphere) and high pressure (above sphere) is used creating cavitation, oscillation or vortex through to the wellbore to remove scale and debris from the well.

BACKGROUND OF THE INVENTION

Current flow patterns, which consist of static flow, cavitation, acoustic (pulsating) and oscillation, helical, and spinning nozzles, are limited to pressures, temperatures, fluid type and volumes. Current technologies can only create one or two type of fluid patterns, which limits the functionality when cleaning out Wells. Some may have mechanical moving parts to create such patterns during operation. However, the moving parts increase the need for repair and maintenance.

SUMMARY OF THE INVENTION

The objective of the present invention is to create a fluid pattern with three variables flow patterns, cavitation, helical and acoustic (pulsating) and oscillating methods with no mechanical moving parts within the technology without being limited to pressures, temperatures, volumes or fluid type. There are varying sized bearings/spheres that can be placed in each chamber that are hydraulically driven that reduce the total flow area (instead of slow down the fluid). The present invention can produce a cavitation, oscillating and helical action, accelerated through a vortices effect, as the fluid or gases exit the technology.

BRIEF DESCRIPTION OF THE DRAWINGS

FIG. 1 is a perspective view of the present invention with a description of the process, general placement of the bearings (when used), general tool sizes and specifications.

FIG. 2 is a cross cut view of the components of the present invention.

DETAILED DESCRIPTION OF THE INVENTION

Referring now to the invention in more detail, FIG. 1 of the present invention, which can be made of 4140 carbon steel, stainless steel, ceramics, titanium, or other alloys, shows how fluid enters through a fluid entry & resonating expansion chamber #1, where a vortices effect is created; and into dual fluid paths #1, which induce the helical pattern; then enters a resonating expansion chamber #2, where the two flow paths are comingled and the vortices effect is enhanced; then flows through dual fluid paths #2, which maintains the induced helical pattern; then comingled into an expansion chamber #3; where the vortices effect is maintained until it flows out of the multi-port oriented nozzle head with port orientations of 15, 30, 45 and 90 degrees. The fluid may also exit out through a single exit point that connects to a drill string. FIG. 1 also shows the bearings/spheres, which can be of varying size, that can be placed in each chamber that are hydraulically driven that reduce the total flow area (instead of slow down the fluid).

FIG. 2 details a cross cut view of the present invention's parts and layout: A) single thread connector; B) resonating chamber #1 with dual fluid path #1; C) resonating chamber #2 with dual fluid path #2; D) single exit threaded connector; E) sphere/bearing insert (which can be varying sizes) for cavitation; and F) multiport oriented nozzle.

The advantages of the present invention include, without limitation, that more scale and debris build-up can be effectively and efficiently removed from a Well, create turbulent flow pockets within the annulus to keep debris in suspension for a longer period of time, reduce friction within a drill string or coil tubing string, and clean perforations and near region that surrounds the Well.

In broad embodiment, the present invention is a vortices nozzle that creates a fluid pattern with cavitation, helical, and acoustic (pulsating) and oscillating methods with no mechanical moving parts within the invention and with no limit to pressure, temperature, volume or fluid type.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art, which are encompassed within the spirit of the invention. Although the invention has been described in connection with specific preferred embodiments, it should be understood that the invention, as claimed, should not be unduly limited to such specific embodiments. Indeed, various modifications of the described modes for carrying out the invention, which are obvious to those skilled in the art.

What is claimed is:

1. A vortices Induced helical fluid nozzle delivery system for assisting with extended reach within a well for properly cleaning out a well or near regions of a well comprising:

said delivery apparatus is attachable to a threaded upper end of a tubing string pipe, wherein said nozzle fluid delivery apparatus delivers fluid through apparatus creating three flow patterns selected from the group consisting of cavitation, helical and acoustic pulsating, oscillating flow patterns through vortices comprising a plurality of holes, said fluid flowing from a smaller hole into a larger hole thereby creating vortices within the expansion chamber wherein a single a single flow of fluid that flows into a single resonating expansion chamber and into two asymmetrical fluid paths wherein the two flow paths are commingled and flows into second and third expansion chambers and wherein said fluid flow out of said fluid delivery apparatus through a multi-port oriented nozzle head.

2. The apparatus of claim 1 wherein bearings or spheres are disposed within said expansion chambers to reduce the flow area, increase fluid volume and facilitate low pressure and high pressure regions within said chambers.

3. The apparatus of claim 1, wherein said multi-port helical fluid nozzle further comprising a single port exit or multiple exit ports orientation of 15, 30, 45 and 90 degrees such that the total flow area being subsequently divided by the number of ports relative to said expansion chamber size.

4. A method of delivering of fluid flow to a wellbore using the fluid delivery system of claim 1, for cleaning geological formations, well plugs, sand, cement plugs, debris, and scale buildup from within a wellbore or drill string comprising:

attaching said apparatus to a coiled tubing or drilling pipe;

introducing intake fluid into the expansion chambers:

generating asymmetrical pathways and vortices of the apparatus causing the fluid flow to go from static flow to cavitation, acoustic, oscillating flows through said vortices;

exiting said fluid through said multi-port nozzle of the apparatus in a turbulent flow pattern which removes debris and buildup in the well bore or drill string.

* * * * *